US005742253A

United States Patent [19]

Conroy et al.

[11] Patent Number: 5,742,253

[45] Date of Patent: Apr. 21, 1998

[54] SYSTEM AND METHOD FOR CONTROLLING THE PHASE OF AN ANTENNA ARRAY

[75] Inventors: Bruce Conroy, Altadena; Daniel Hoppe, Saugus, both of Calif.

[73] Assignee: California Institute of Technology, Pasadena, Calif.

[21] Appl. No.: 615,505

[22] Filed: Mar. 12, 1996

[51] Int. Cl.[6] ..... H01Q 3/22; H01Q 3/24

[52] U.S. Cl. ..... 342/372; 342/354

[58] Field of Search ..... 342/370, 372, 342/354; 244/62

[56] References Cited

U.S. PATENT DOCUMENTS

| | | | |
|---|---|---|---|
| 4,233,606 | 11/1980 | Chernoff | 342/370 |
| 4,955,562 | 9/1990 | Martin et al. | 244/62 |
| 5,400,037 | 3/1995 | East | 342/372 |

OTHER PUBLICATIONS

East, Thomas W.R., *A Self-Steering Array for the Sharp Microwave-Powered Aircraft*, IEEE Transactions on Antennas and Propagation, 10(12):1565, 1992.

*Primary Examiner*—Gregory C. Issing
*Attorney, Agent, or Firm*—Fish & Richardson P.C.

[57] ABSTRACT

A system and method for controlling power transferred to an aircraft. The system includes a master antenna and a plurality of slave antennas on the ground. Each slave antenna transmits an uplink signal of a unique phase modulated frequency. The master antenna transmits a master uplink signal. The aircraft receives all the uplink signals and modulates a composite of those signals to produce a downlink beacon that has multiple phase components, each of which corresponds to one of the slave antennas and has a unique frequency. Each of the slave antennas receives the downlink beacon and uses the corresponding phase component to adjust the phase of the slave uplink signal relative to the master uplink signal.

21 Claims, 5 Drawing Sheets

SYSTEM AND METHOD FOR CONTROLLING THE PHASE OF AN ANTENNA ARRAY

STATEMENT AS TO FEDERALLY SPONSORED RESEARCH

The invention described herein was made in the performance of work under a NASA contract and is subject to the provisions of Public Law 96-517 (35 U.S.C. §202), in which the Contractor has elected to retain title.

BACKGROUND OF THE INVENTION

1. Field of the Invention

This invention relates to a system for controlling power delivered to a powered aircraft. More particularly, this invention relates to a system and method for controlling the phase of multiple ground antennas in order to efficiently deliver power to an orbiting microwave-powered aircraft. (For convenience, the term "aircraft" will be used throughout the remainder of this specification and is intended to encompass airplanes, satellites, and other aircraft and orbiting powered craft.)

2. Background and Summary

Microwaves have been used to beam power to orbiting aircraft as well as for other power beaming applications. Generally, microwave-powered aircraft are light and are controlled by microwave energy beamed to the aircraft by an array of ground antennas.

A number of techniques have been developed for pointing and phasing an array of ground antennas in order to effectively deliver power to the aircraft. A summary of such techniques is provided in an article by Thomas W. East, "A Self-Steering Array for the SHARP Microwave-Powered Aircraft," IEEE Trans. AP, Vol. 40, No. 12, at 1565–1567 (December 1992). Each of those techniques suffers from disadvantages, however, as will be described below.

A first technique operates on a phased antenna array concept, where the phase of each drive signal to a ground amplifier is computed as a function of time to correctly phase the beam of each antenna. No feedback (e.g., downlink signal) from the aircraft is required.

This first technique, however, requires accurate calibration of the phase delay introduced by each transmitter, cable, antenna, etc. Moreover, an extensive calibration procedure is required, and it must be repeated periodically to correct for temperature and other unknown effects. In addition, two factors make using phased array techniques for high-power microwave-powered aircraft more complicated than in a low-power phased array antenna: (1) The phase shift through high-power klystrons is sensitive to beam voltage stability and coolant temperature, and both must be strictly controlled for such a system to succeed; and (2) the array elements for microwave-powered aircraft must move, unlike typical phased array antennas, in which the antennas are rigidly mounted. This second factor adds additional instability to the system relative to a typical phased array. This first technique also appears to be quite risky for microwave-powered aircraft, because it is an open loop system.

A second technique, a retrodirective array, employs a beacon transmitted by the aircraft that is received by each antenna in the array. The phase of the received signal is compared to a ground reference, and the negative of the phase difference is applied to the transmitter (i.e., phase conjugation). Additional computations are required to adjust the transmitted phase if the beacon signal is at a different frequency from the uplink signal. It is not necessary to time-multiplex the beacon downlink and the high power uplink when a different frequency is used, as would be the case if both were at the same frequency.

A phase stable reference is required, however, in the retrodirective array technique, whether or not the beacon is at a different frequency. In addition, each array element must have a receiver, and any relative phase instability in the reference between sites is translated into a pointing error in the retrodirective array system. Finally, the retrodirective array technique is still an indirect method, because the uplink signal is not used directly in the phasing loop.

A third technique that has been employed is called beam tagging. Beam tagging uses at least two antennas, one of which serves as a reference (or "master antenna"), while the others ("slave antennas") are phase modulated. The resultant signal from the master and slave antennas is captured on the aircraft, and the modulation on the signal is stripped-off and returned to a single ground antenna that may or may not be one of the array antennas. The depth of the modulation is used to determine the magnitude of the phase error, while the phase of the modulation determines the sign of the phase error.

Conventional beam tagging techniques are problematic, however, when a large antenna array is employed, because an array with more than two antennas adds complexity to phase adjusting. One way to adjust the phase of an antenna array with more than one slave antenna is to step though the slave antennas one at a time (i.e., serially), each time phasing the signal from one slave antenna with the resultant signal of the remaining slave antennas. All of the slave antennas will be phased correctly after a number of passes through the antenna array, assuming the time required for one pass is slow compared to the expected phasing errors. The beam is always focused at a point behind the aircraft, however, because of the time it takes to iterate over the antennas.

Accordingly, the inventors recognized the need for a system and method for controlling the phase of an antenna array with more than one slave antenna in order to efficiently deliver power to a powered aircraft and for effectively pointing the antenna array at the aircraft.

It is an object of the present invention to provide efficient microwave power to an aircraft from an array of ground-based antennas.

It is a further object of the present invention to provide a way to direct or point the antenna array at the aircraft.

In accordance with the present invention, to adjust the phase of a beam tagging antenna array with more than one slave antenna, each slave antenna is tagged with a unique frequency. Each slave antenna's transmitted phase can then be adjusted by examining a specific modulation frequency. All of the slave antenna phase adjustments may be made in parallel, as opposed to in serial, like the time stepping method described above. In addition, this method for phase adjusting in the beam tagging technique can include any of a number of phase dithering techniques in order to peak the antenna power.

One aspect of the present invention is a system for controlling power transmitted to an aircraft. The system includes an array of antennas, one of which is a "master" antenna and the rest of which are "slave" antennas. Each of the antennas includes a transceiver. The master transceiver transmits a master uplink signal, and each slave transmitter transmits a slave uplink signal. Each slave uplink signal is phase modulated at a unique frequency. The aircraft includes a receiver that receives the master and slave uplink signals and combines those signals into a composite signal. The composite signal is then modulated to produce a beacon that has multiple phase components, each corresponding to one of the slave antennas, and each of which has a unique frequency. The beacon is transmitted from the aircraft to the ground, where the beacon is received by the slave antennas. Each slave antenna then uses its corresponding phase component to adjust the phase of the slave-uplink signal relative to the master uplink signal.

The beacon can also be used to point the master and slave antennas at the aircraft. This is done by producing error and sum signals, which are then filtered and used to point the antennas.

This system can be totally independent of any other telemetry links from the aircraft. Further, the system is highly flexible and expandable and may be implemented with a small number of components that are well-known in the art.

The details of the preferred embodiment of the present invention are set forth in the accompanying drawings and the description below. Once the details of the invention are known, numerous additional innovations and changes will become obvious to one skilled in the art.

BRIEF DESCRIPTION OF THE DRAWINGS

These and other aspects of the invention will now be described in detail with reference to the accompanying drawings, wherein.

DETAILED DESCRIPTION OF THE INVENTION

Figure 1:
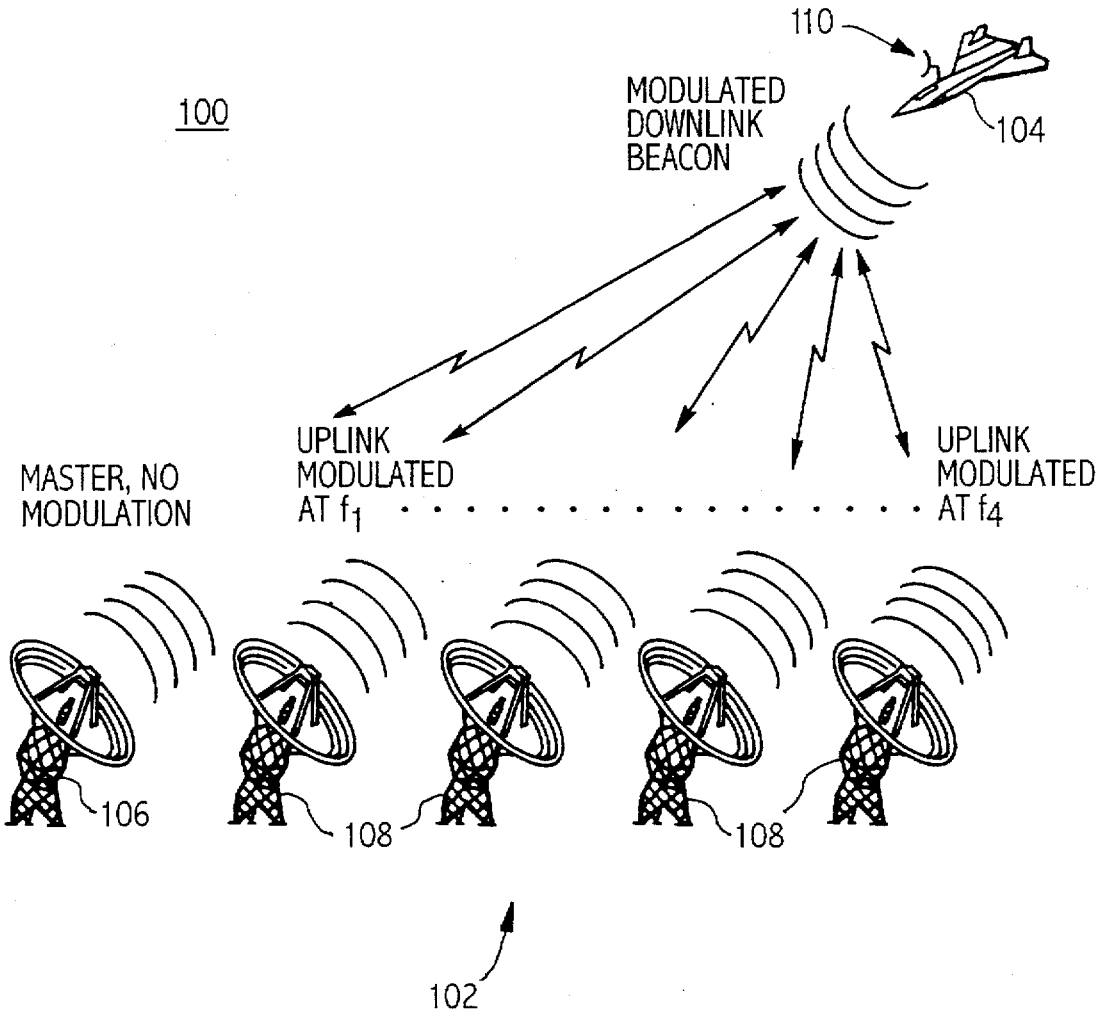
FIG. 1 is a diagram of the system of the present invention showing an array of ground antennas in communication with an aircraft.

Throughout this description, the preferred embodiment and examples shown should be considered as exemplars, rather than as limitations on the present invention.

I. Overview of the System

The present invention is a system and method for controlling the phase of multiple ground antennas (i.e., an antenna array) in order to efficiently deliver power to microwave-powered aircraft. The system is shown in FIG. 1 and is designated generally by reference numeral 100.

The system of FIG. 1 includes an antenna array 102 and an aircraft 104. The antenna array 104 includes a master antenna 106 and a plurality of slave antennas 108. Each of the antennas 106, 108 is preferably a high-powered antenna and transmits an uplink signal to the aircraft 104. The master uplink signal is not modulated, while each of the slave uplink signals is phase modulated at a unique frequency. Unique phase modulation allows simultaneous phasing of all slave antennas 108. The phase of each slave antenna 108 is controlled with respect to the others so that all the signals add at the plane and do not cancel out.

The master and slave uplink signals are received by the aircraft 104, preferably by a rectenna 110 on the aircraft 104. Rectennas are described in co-pending U.S. patent application Ser. No. 08/498,481, filed on Jul. 5, 1995, and assigned to the same assignee as the present invention. The aircraft 104 is preferably powered by microwave energy. A sample of the uplink signals received by the aircraft 104 is then rectified, filtered, and modulated onto a downlink beacon (preferably a high-frequency signal of about 11–20 Ghz). The modulated high-frequency downlink beacon provides the relative phase information of each slave antenna 108 at a unique frequency, so that the phase of each slave antenna 108 can be adjusted relative to the master antenna 106.

The downlink beacon is transmitted by the aircraft 104 and received by the antenna array 102. The phase information contained in the downlink beacon is then used by each of the slave antennas 108 to adjust its phase relative to the master antenna 106. Thus, the downlink beacon conveys phase error information back to the ground for closing phase loops. The downlink beacon also provides a means for pointing the antennas 102 at the aircraft 104, because the downlink beacon carries a monopulse tracking signal.

The system 100 of the present invention is easily expandable by adding slave antennas 108 and additional corresponding modulation frequencies. If desired, the antenna array 102 can be pointed at the aircraft 104 without turning on the antennas.

Figure 2:
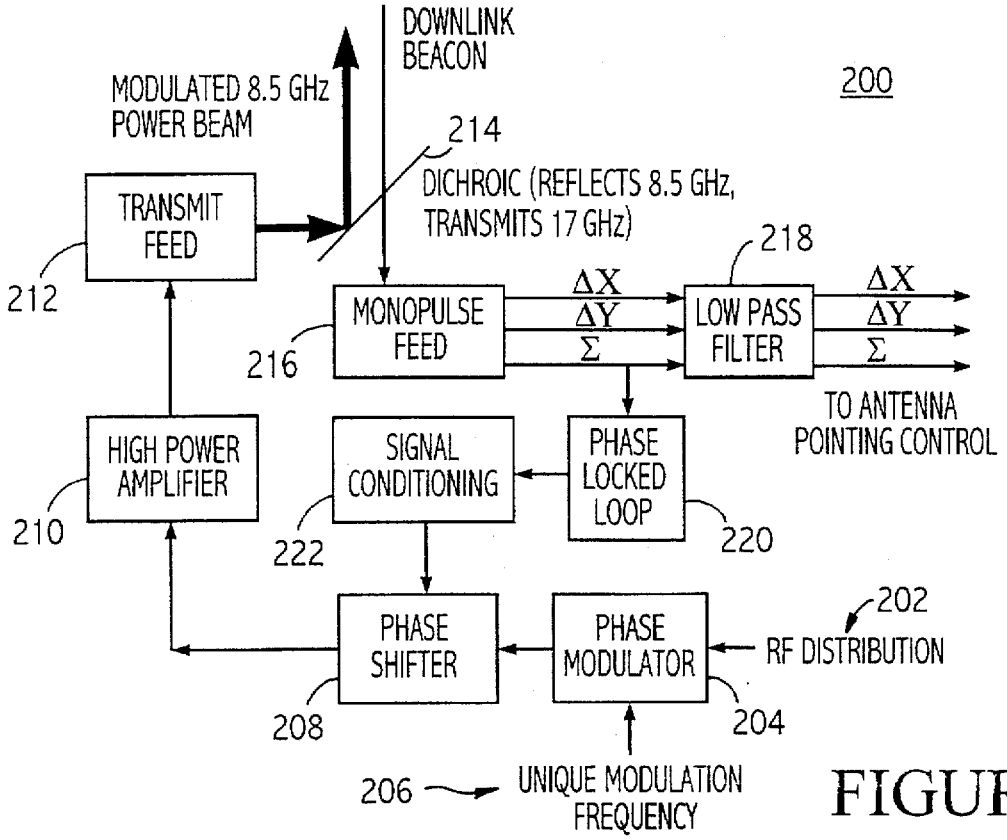
FIG. 2 is a functional block diagram of the subsystem of each slave ground antenna for producing a phased uplink signal and for pointing the slave antennas at the aircraft.

FIG. 2 is a functional block diagram of the ground antenna subsystem 200 of the present invention. Each slave antenna 108 includes subsystem 200, which generates a slave uplink signal via a common RF distribution system 202 and a phase modulator 204. The phase modulator 204 modulates the signal from the RF distribution system 202 with a modulation frequency 206 that is unique to each particular subsystem 200. The phase-modulated uplink signal then passes through a phase shifter 208 into a high-power amplifier 210 and then to a transmit feed 212.

The high-power uplink signal encounters a dichroic (frequency selective) surface 214, which reflects the uplink signal to a subreflector (not shown). FIG. 2 shows the dichroic surface 214 reflecting a signal having a frequency of 8.5 Ghz and transmitting a signal having a frequency of 17 Ghz. These frequencies are merely exemplary, however, and those skilled in the art will recognize that other frequencies may be employed.

The downlink beacon (emanating from the aircraft 104) is received by each slave antenna 108 at about the same time the high-power slave uplink signal is reflected off the dichroic surface 214. The downlink beacon (shown as having a frequency of 17 GHz) passes through the dichroic surface 214 into a monopulse receive feed 216. The monopulse receive 216 then produces error signals ($\Delta x$ and $\Delta y$, as shown), as well as a sum signal ($\Sigma$). The error and sum signals are filtered by a low pass filter 218 and are then used to point the antenna 108 to a high accuracy. A sample of the sum signal ($\Sigma$) is also demodulated using a phase-locked loop 220, and the appropriate phase modulation component for the particular subsystem 200 is filtered out using a band pass filter (or signal conditioning circuit) 222. The amplitude of the phase modulation component is then used to adjust the phase shifter 208 and to thereby adjust the phase of the slave antenna 108 relative to the master antenna 106. The system 100 performs optimally when the amplitude of each modulation component is a minimum.

Figure 3:
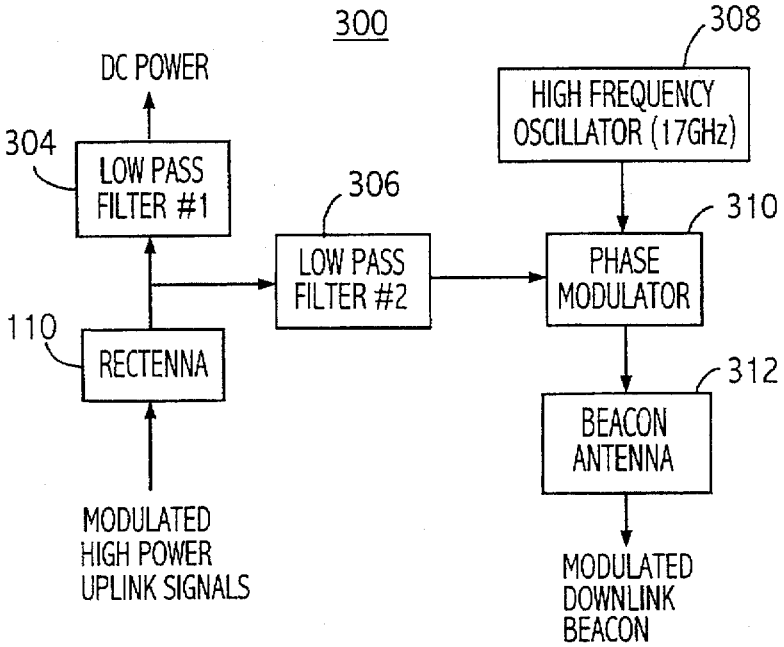
FIG. 3 is a functional block diagram of the subsystem of the aircraft for receiving signals from the antenna array and producing a downlink beacon.

FIG. 3 shows a functional block diagram of the subsystem 300 of the aircraft 104. Subsystem 300 includes a rectenna 110, a first low-pass filter 304, a second low-pass filter 306, a high-frequency oscillator 308, a phase modulator 310, and a beacon antenna 312. The master and slave uplink signals are received by the rectenna 110 and rectified. The rectified composite signal is filtered by the first low-pass filter 304, providing DC power to the aircraft 104. A sample of the rectified composite signal is also filtered by the second low-pass filter 306 and is modulated by the phase modulator 308 onto the high-frequency downlink beacon, which is generated by the high-frequency oscillator 310. The modulated downlink beacon then contains the relative phase information of each of the slave antennas 108 at a unique frequency. The downlink beacon is transmitted by the beacon antenna 312 to the antenna array 102 on the ground. As described above, each slave antenna 108 then uses the phase information from the downlink beacon to adjust its phase shift relative to the master antenna 106.

II. Phase Error Equations

Consider the case of just two antennas, a master 106 and a slave 108, in order to understand how the phase loop 220 gets the proper feedback. (For convenience, throughout this description the subsystem 200 and its transmitter section will generally be referred to as an "antenna.") The master antenna 106 transmits a master uplink signal at some frequency $\omega_0$, amplitude $A_0$, and zero phase. The slave antenna 108 transmits a slave uplink signal having amplitude $A_1$, phase $\phi_1$, that is phase modulated with a tone having modulation index $\alpha_1$ and frequency $\omega_1$. The sum of these two signals at the rectenna 110 can be expressed as:

$$E(t)=A_0\cos(\omega_0 t)+A_1\cos(\omega_0 t+\phi_1+\alpha_1\cos(\omega_1 t))$$

The effect of rectifying can be approximated by squaring the signal:

$$E^2(t)=A_0^2\cos^2(\omega_0 t)+A_1^2\cos^2(\omega_0 t+\phi_1+\alpha_1\cos(\phi_1 t))+2A_0A_1\cos(\omega_0 t)\cos(\omega_0 t+\phi_1+\alpha_1\cos(\omega_1 t)).$$

The first 2 terms of the above equation will contain only DC and double frequency terms that will be rejected by a DC block and low pass filter, leaving only the third term. The third term may be further expanded using the identity:

$$\cos(a)\cos(b)=\tfrac{1}{2}[\cos(a+b)+\cos(a-b)].$$

The first term of this expansion is also a double frequency term, which is rejected using a low pass filter, leaving:

$$A_0A_1\cos(\phi_1+\alpha_1\cos(\omega_1 t))=$$

$$A_0A_1[\cos(\phi_1)\cos(\alpha_1\cos(\omega_1 t))-\sin(\phi_1)\sin(\alpha_1\cos(\omega_1 t))].$$

If $\alpha_1$ is kept small so that $$\cos(\alpha_1\cos(\omega_1 t))\approx 1,$$

and $$\sin(\alpha_1\cos(\omega_1 t))\approx\alpha_1\cos(\omega_1 t),$$

the resulting signal is:

$$A_0A_1[\cos(\phi_1)-\alpha_1\sin(\phi_1)\cos(\omega_1 t)].$$

The first term in the preceding signal is DC, and the second term is a low frequency tone at the original modulation frequency. The amplitude of the signal depends on the original signal amplitudes, the modulation index, and the sine of the phase error ($\omega_1$). The object is to force $\omega_1$ to zero. This means that $\omega_1$ has two important properties: (1) It goes to zero when the phase is zero, so that a loop that minimizes the amplitude of the resulting tone will minimize the phase error; and (2) The direction of the phase error is preserved. In other words, the sign of the tone amplitude will change, if the phase of the slave antenna 108 goes from being ahead of the master antenna 106 to being behind it.

III. Additional Factors Accounted for in Controlling Relative Phase

The above phase error equations show that there is enough information in the low frequency terms that will be produced by the rectenna 110 to control the relative phase of the slave antennas 108. Still, a number of additional factors must be accounted for in controlling the relative phase. These factors are: loop coupling, loop gain calibration, and range calibration, all of which are described in detail in the following sections.

A. Loop Coupling

The amplitude of the tone from each slave antenna 108, when more than one such antenna is in the system 100, will depend on the phase difference between a particular slave antenna modulated with that tone and the average phase of all the other slave antennas. A single slave antenna 108 that goes out of phase with the rest of the slave antennas 108 will have a small effect on the average phase of the resultant signal seen by each of the others. This will produce a tone response in all of the phase loops. Fortunately, the effect on the average phase is much smaller than phase error in the "bad" antenna, so that the correct tone is much higher than the others.

Also, all tones will go to zero when all the phases are correct. Thus, the only effect of this coupling is that the phases spiral into the correct solution, rather than going directly to the correct solution.

B. Loop Gain Calibration

As seen above, the amplitude of each tone is dependant on the amplitude of each slave antenna 108 and the modulation index. The amplitude of each tone in a complete system will also depend on many other factors, such as the beacon modulator gain, the path losses, and the ground receiver gain. A loop gain calibration mechanism should be included in the present system 100 to provide acceptable loop performance. This can be done by a phase control computer either before the loops are locked, or periodically during operation.

The phase of a single loop is forced to go through at least a full cycle while sampling the resultant tone amplitude to calibrate the gain of that loop. The computer then calculates the loop gain from the peak amplitude detected.

A small offset frequency is added in order to introduce the phase shift. The offset should be large enough to guarantee the phase will go through a full cycle in a reasonable length of time, yet small enough to guarantee that a sampling rate of the phase control computer will be able to resolve the peak tone amplitude. This should be considered when choosing the rate at which the phase control computer makes its measurements.

C. Range Calibration

The system 100 is sensitive to phase shifts in the modulator, path, and receiver. This is because the sign of the phase error is determined from the phase of the detected tone. The modulator and receiver path phase shifts of the subsystem 200 can (and should) be calibrated out, but the phase shift from the transmission path will depend on the distance from the ground antenna array 102 to the aircraft 104. This means that the overall system 100 must provide a range input to the phase control computer. The actual requirement is that the phase be known to within 90 degrees at the highest modulation frequency. Preferably, this highest frequency is less than 3 kHz, which implies that it is adequate to know the round trip time, from the antenna array 102 to aircraft 104 and back to the antenna array 102, within 83 microseconds. This corresponds to a knowledge of the one way path to within 12.5 km.

IV. Simulations

Simulations of the phase loops were done by using update times of 20, 30, and 100 mS. These correspond to loop update rates of 50, 33, and 10 Hz. The 10 Hz rate was unsatisfactory. The 33 Hz rate always locked up, but sometimes took several seconds to do so. The 50 Hz rate always locked up in less than 1 second. Thus, the 50 Hz update rate was chosen. This means that the phase control computer has 20 mS to do a complete update. 10 mS of this time was selected to be devoted to sampling the composite error signal. This means that when the Fast-Fourier Transformation ("FFT") of the signal is completed, each bin in the result will represent 100 Hz. The FFT effectively divides the signal into its Fourier components. FFT results in signals that describe amplitude at particular frequencies (or "bins").

The number of samples should be a power of 2 to simplify the FFT. Thus, 32 samples in 10 ms was chosen. This gives a sampling rate of 3.2 kHz, and a Nyquist limit of 1.6 kHz. The tone frequencies were chosen to be 300, 500, 700, 1100, and 1300 Hz. These tone frequencies are small prime numbers when multiplied by the 100 Hz bin frequency and are all less than the Nyquist limit.

The phase control computer uses the other 10 ms of the update time to do the 32 point FFT, pick bins that correspond to the modulation tones, adjust for the round trip phase delay, and update each of the control loops.

Two simulations of the system 100 were performed using the above parameters. The first simulation modeled the geometry of the ground station antennas 102 and the flight path of the aircraft 104, but ignored the return beacon link and the FFT processing. This was done to make sure that the cross coupling of the loops did not degrade the performance. The second simulation included rectification at the rectenna 302 and FFT processing of the error signal.

A. Simulation One: Loop with Ideal Feedback

The first simulation was done primarily to show that the cross coupling of the various loops would not significantly degrade system performance. A model of the system was written in the Ada programing language. The model included the geometry of the ground antennas 102 and the effects of high altitude winds on the flight path of the aircraft 104. The feedback term was derived from the full expansion of the modulated voltages from six antennas being rectified by a square law rectenna. The main approximation in this simulation is that each loop feedback term is taken from the analytic expression without undergoing the modulation and FFT processing that will be required in the actual system.

Figure 4:
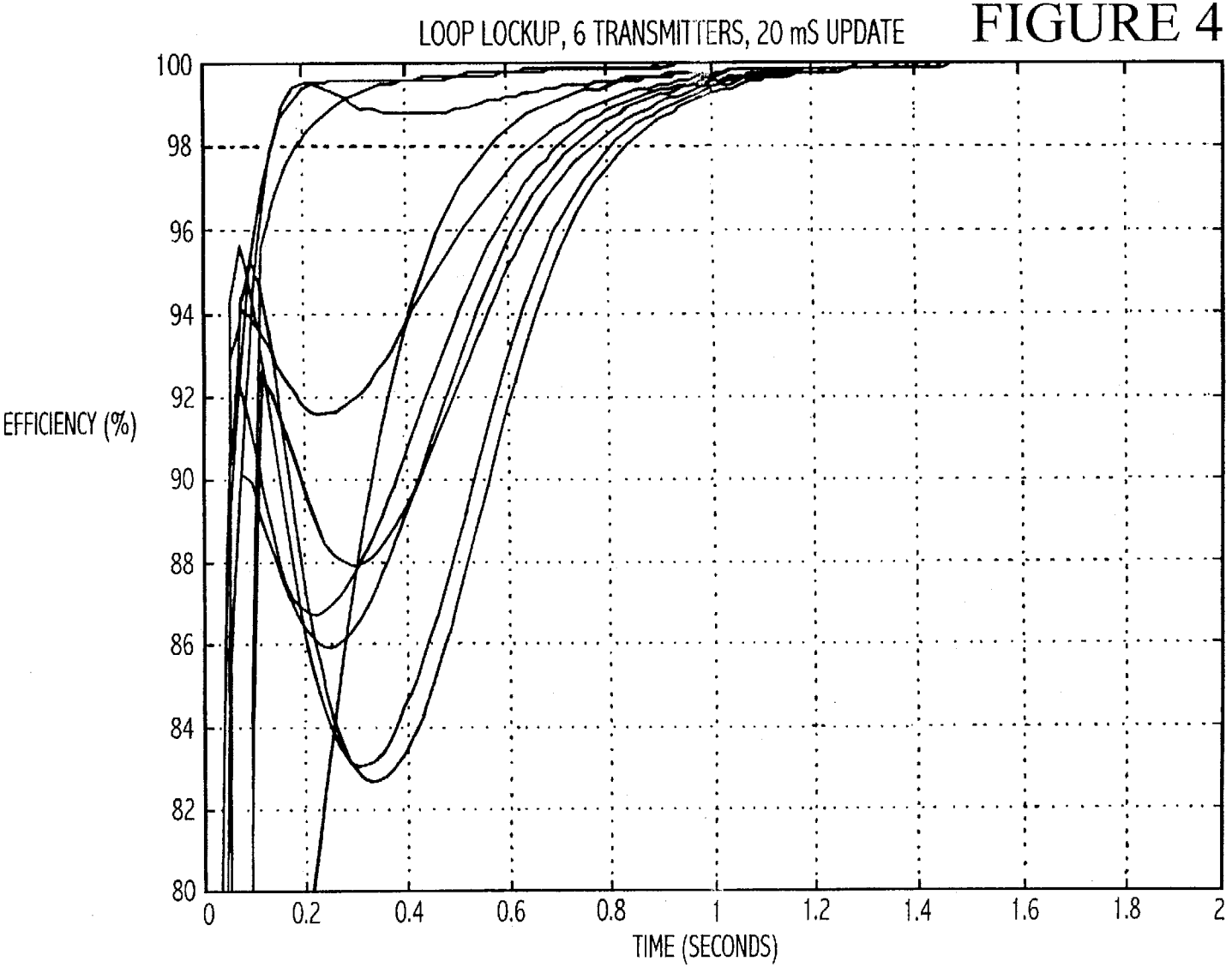
FIG. 4 is a graph showing a loop lockup with the preferred system of 6 slave antennas and a 20 ms update rate.

The simulation was used to try different loop update rates and other loop parameters. One series of tests involved resetting all of the phase loops every two seconds to get a large number of acquisition phases. FIG. 4 is a plot of 10 such successive loop acquisitions, plotting the combining efficiency (which is a measure of the total RMS phase error in all phase loops at once) versus time since the loops were reset. This plot was done at the recommended update time of 20 ms (50 Hz rate). The plot shows that the combining efficiency is always above 99% within one second.

B. Simulation Two: Loop with FFT Feedback

The second simulation was used to verify operability of the proposed system of using FFT processing of the combined error signal. The wind effect on the flight path of the aircraft 104 was omitted, but the simulation of the overall feedback mechanism was much more accurate.

Figure 5:
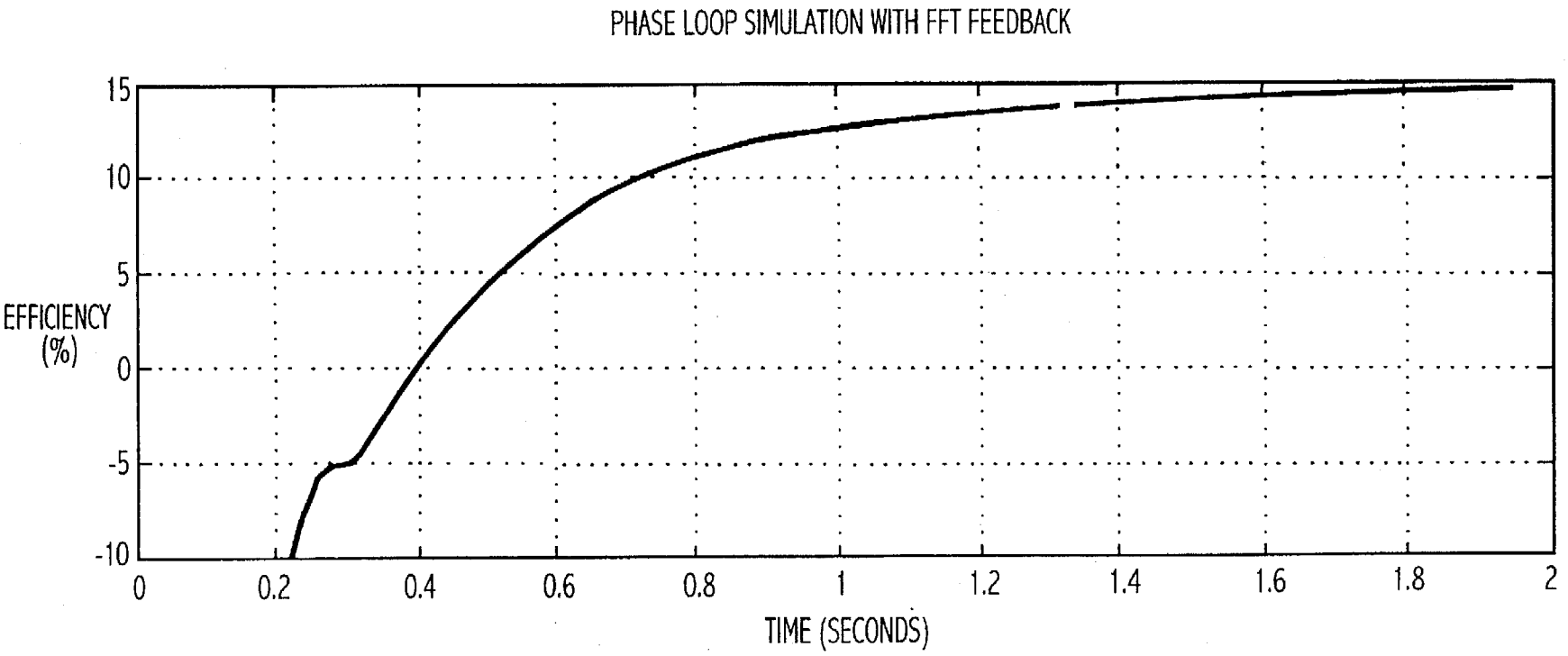
FIG. 5 is a graph showing combining efficiency in a phase loop simulation in accordance with the present invention.
Figure 6:
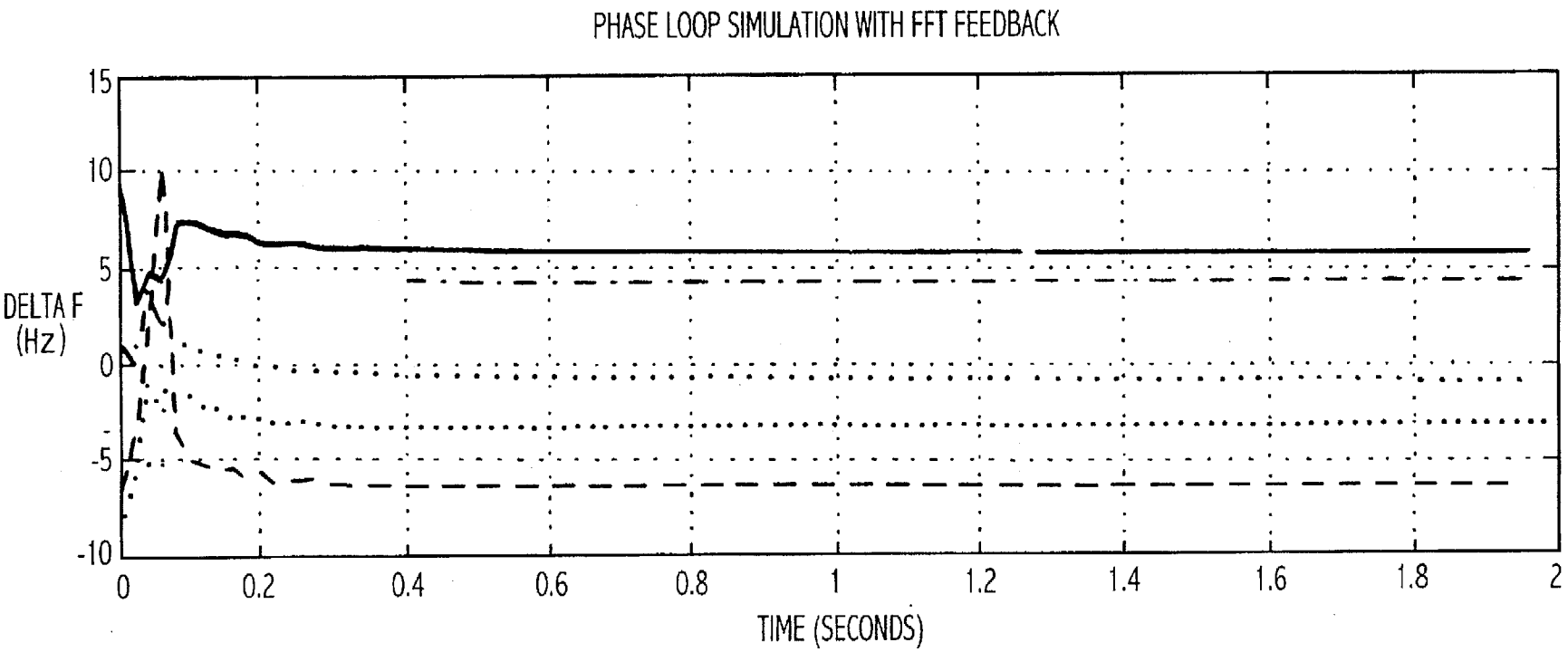
FIG. 6 is a graph showing frequency offsets in a phase loop simulation in accordance with the present invention.

The second simulation was written in the Matlab programming language and is presented below as three files, LOOP_START, LOOP_SIM, and LOOP_PLOT. LOOP_START is Listing 1 and sets all the parameters needed for the simulation. LOOP_SIM is Listing 2 and does the simulation for the number of seconds specified by the parameter "max time" from LOOP_START. The third Listing, presented in LOOP_PLOT, plots the final results. The reason for making the actual simulation as a separate step was to allow longer simulations by running LOOP_SIM more than once without resetting the loops. The code for the three Listings is as follows:

FIG. 5 is a typical plot produced by LOOP_PLOT. The upper trace is the combining efficiency (again above 99% within 1 second). FIG. 6 shows the resultant frequency offsets as a function of time between five slave antennas 108 and the master antenna 106.

This model also allowed the use of different rectifier models, while the analytic model (simulation one) was limited to a pure square law rectifier. Simulations with square law, full wave, and half wave models showed no significant differences.

V. Beacon Link Calculation

TABLE 1 (below) presents a link calculation for the RF link from the downlink beacon on the aircraft 104 to the ground antennas 102. This calculation is quite conservative, in that the beacon transmitter power is only 1 mW, the efficiency of the ground antenna is only 10%, and the receiver noise temperature is 500 Kelvin. The resulting signal to noise ratio (SNR) is over 55 dB, even with these conservative assumptions.

TABLE 1

Link Calculation for the Downlink Beacon & Phase Feedback

| Parameter | Value |
|---|---|
| Transmitter Power | 0.001 Watts |
| Transmitter Gain | 1 |
| Frequency | 1.7e10 Hz |
| Slant Range | 25000 meters |
| Receive Diameter | 24 meters |
| Receive Efficiency | 0.1 |
| Effective Area | 180.9557 meter^2 |
| Received Signal | 2.30e-11 Watts |
| Noise Temperature | 500 Kelvin |
| Receive Bandwidth | 10000 Hz |
| Plank's Constant | 1.38e-23 Watts/Hz*K |
| Received Noise | 6.9e-17 Watts |
| SNR | 55.23633 dB |

The system 100 of the present invention uses a small number of components and adds only a simple oscillator, phase modulator, and antenna on the aircraft 104. All of the components are well understood in the art. The system 100 for pointing and phasing the antenna array 102 is totally independent of any other telemetry links from the aircraft 104. The system 100 is expandable by simply adding more slave antennas 108 (and associated transmitters) and more corresponding modulation frequencies. The system 100 is also flexible in terms of the exact beacon frequency. Moreover, the antenna array 102 can be pointed at the aircraft 104 without turning on the high power transmitters, if required.

Although only a few embodiments have been described above, those having ordinary skill in the art will readily realize that many modifications are possible without departing from the advantageous teaching herein. For example, any number of slave antennas 108 can be employed in the antenna array 102 by adding another unique modulation frequency for the added slave antenna. Also, the ground subsystem 200 may be configured differently from what is shown in FIG. 2. Other similar modifications will also be apparent to those having ordinary skill in the art and are intended to be encompassed within the following claims.

DOCKET: 06816/037001
CIT-2424
JPL 19647

Listing 1.

```
% LOOP_START
% set parameters for LOOP_SIM
% 94.1012 BLC
plane_z=21300;
plane_radius=6000;
plane_period=240; % seconds
site_z=1200;
antenna_diameter=30;
update_time=.02; % 50 per sec
% gains for PI type loop
p_gain=.3;
i_gain=.6;
% general constants
c=3e8;
carrier=8.57e9;
number_of_antenna=6;
% position the antennas, 1 in the center, rest around circle
angle=2*pi*(0:number_of_antenna -2)/(number_of_antenna-1);
txr_x=antenna_diameter*[0 cos(angle)];
txr_y=antenna_diameter*[0 sin(angle)];
txr_z=site_z*ones(size(txr_x));
% time offset to put plane at arbitrary location
t_start = 15 ; % seconds
% parameters for the sample/FFT part
t_sample=0.01;
samples=512;
t=(0:samples-1)*t_sample/samples;
```

```
bins=(0:size(t,2)-1)/t_sample;
omega0=2*pi*10e3;
phi_index=.2;
tag=[0 200 300 500 700 1100]*pi*2;
tag_bin=[0 2 3 5 7 11]+1;
time=0;
delta_f=zeros(1,number_of_antenna);
txr_phase=zeros(1,number_of_antenna);
i_term=zeros(1,number_of_antenna); % keep first,
     but not used
max_time=2;
time_history=[];
eta_history=[];
delta_f_history=[];
```

Listing 2.

```
% LOOP_SIM
% full loop simulation with modulation and FFT feedback
% 94.1013 BLC
% loop for the simulation
for ITER=1:max_time/update_time;
     time_history=[time_history time];
     % get the plane position
     plane_x=plane_radius*sin(2*pi*(time+t_start)/
          plane_period);
     plane_y=plane_radius*cos(2*pi*(time+t_start)/
          plane_period);
     % update the txr_phase (in cycles)
```

```
txr_phase=txr phase+update_time*delta_f;
% propagate the phase to the plane
r_vector=sqrt((txr_x - plane_x).^2 + ...
              (txr_y - plane_y).^2 + ...
              (txr_z - plane_z).^2);
% convert to radians
plane_phase=rem(txr_phase +
     (carrier+delta_f).*r_vector/c,1)*2*pi;
% get the combining efficiency
eta=abs(sum(exp(i*plane_phase)))^2/
(number_of_antenna^2);
eta_history=[eta_history eta];
% modulate the carrier
v=cos(omega0*t + plane_phase(1));
for I=2:size(plane_phase,2)
v=v+cos(plane_phase(in)+omega0*t+
     phi_index*cos(tag(in)*t));
end;
% rectify
v_rect=abs(v);
% detect the tags
spectrum=fft(v_rect);
e_term=real(spectrum(tag_bin));
% update the integral
i_term=i_term + update_time*e_term;
i_term(1)=0;
% evaluate the loop
delta_f=i_gain*i_term + p_gain*e term;
```

DOCKET: 06816/037001
CIT-2424
JPL 19647

```
    % reset the center
    delta_f(1) = 0;
    delta_f_history=[delta_f_history delta_f'];
    time=time+update_time;
end;
```

Listing 3.

```
% LOOP_PLT
% script to plot the LOOP_SIM data
% 94.1013 BLC
clf;
subplot(2,1,1);
plot(time_history,eta_history*100);
axis([time_history(1) time 90 100])
ylabel('Efficiency(%)')
title('Phase Loop Simulation with FFT Feedback')
grid;
subplot(2,1,2);
plot(time_history,delta_f_history(2,:), '-', ...
     time_history,delta_f_history(3,:), ':', ...
     time_history,delta_f_history(4,:), '--', ...
     time_history,delta_f_history(5,:), '.', ...
     time_history,delta_f_history(6,:), '-.');
grid;
ylabel('Delta F (Hz)')
xlabel('Time (Seconds)')
```

What is claimed is:

1. A system for controlling power transferred to an aircraft, comprising:

(a) a master antenna for transmitting a master uplink signal;

(b) a plurality of slave antennas, each for transmitting a slave uplink signal that is phase modulated at a frequency different from other slave uplink signals;

(c) a receiver, located on the aircraft, for receiving the master uplink signal and the plurality of slave uplink signals and for producing a composite signal;

(d) a modulator, located on the aircraft, for modulating the composite signal to produce a downlink beacon having a plurality of phase components, each phase component corresponding to one of the slave antennas and having a frequency different from all other phase components; and (e) each of the plurality of slave antennas being further for receiving the downlink beacon and adjusting the phase of the slave uplink signal relative to the master uplink signal using the corresponding phase component.

2. The system of claim 1, further comprising means for pointing the plurality of slave antennas at the aircraft in response to receiving the downlink beacon.

3. The system of claim 2 wherein each slave antenna produces at least one error signal that is used to point the slave antenna at the aircraft.

4. The system of claim 1 wherein each slave antenna includes a dichroic element for reflecting the slave uplink signal and for transmitting the downlink beacon.

5. The system of claim 1 wherein each slave antenna includes means for producing a sum signal, a phase locked loop for demodulating the sum signal, and a signal conditioning circuit for filtering the corresponding phase component from the sum signal.

6. The system of claim 5 wherein the corresponding phase component has an amplitude, each slave antenna further including a phase shifter that uses the amplitude of the phase component to shift the phase of the slave uplink signal.

7. The system of claim 1 wherein the master and slave antennas are microwave antennas and the aircraft is microwave powered.

8. The system of claim 1, further comprising:

(a) a rectenna, located on the aircraft, for receiving and rectifying the slave uplink signals.

9. A system for controlling power transferred to an aircraft comprising:

(a) a master antenna; and (b) a plurality of slave antennas;

wherein the master antenna transmits a master signal and each slave antenna transmits a slave signal to the aircraft, each slave signal phase being modulated at a frequency different from the other slave signals, the master and slave signals being received and modulated by the aircraft to produce a beacon having a plurality of phase components, each phase component corresponding to one of the slave antennas and having a frequency different from the other phase components; and wherein each slave antenna receives the beacon and adjusts the phase of the slave signal relative to the master signal using the corresponding phase component.

10. A system for controlling power transmitted to an aircraft, comprising:

(a) master means, located on the ground, for transmitting a master uplink signal;

(b) plurality of slave means, located on the ground, each for transmitting a slave uplink signal and for receiving a downlink beacon, each slave uplink signal being phase modulated at a frequency different from all other slave uplink signals;

(c) means, located on the aircraft, for:

(1) receiving the master uplink signal and the plurality of slave uplink signals, (2) producing a composite signal from the received master and slave uplink signals, (3) modulating the composite signal to produce the downlink beacon, such that the downlink beacon has a plurality of a phase components, each phase component corresponding to one of the slave transmitters and having a frequency different from other phase components; and (d) each slave means including means for adjusting the phase of the slave uplink signal relative to the master uplink signal using the corresponding phase component.

11. The system of claim 10 wherein each of the plurality of slave means further includes means for pointing the slave antenna at the aircraft in response to receiving the downlink beacon.

12. The system of claim 11 wherein each slave means produces at least one error signal that is used to point the slave means at the aircraft.

13. The system of claim 10, further comprising:

(a) means, located on the aircraft, for receiving and rectifying the slave uplink signals.

14. The system of claim 10 wherein each slave means includes means for producing a sum signal, a phase locked loop for demodulating the sum signal, and a signal conditioning circuit for filtering the corresponding phase component from the sum signal.

15. The system of claim 14 wherein the corresponding phase component has an amplitude, each slave means further including a phase shifter that uses the amplitude of the phase component to shift the phase of the slave uplink signal.

16. A method for controlling power transferred to an aircraft, comprising:

(a) transmitting a master uplink signal;

(b) transmitting a plurality of slave uplink signals, each slave uplink signal being phase modulated at a frequency different from the other slave uplink signals;

(c) receiving the master uplink signal and the plurality of slave uplink signals;

(d) producing a composite signal from the received master uplink signal and plurality of slave uplink signals;

(e) modulating the composite signal to produce a downlink beacon, such that the downlink beacon has a plurality of phase components, each phase component corresponding to one of the slave uplink signals and having a frequency different from the other phase components;

(f) transmitting the downlink beacon by the aircraft; and (g) adjusting the phase of each slave uplink signal relative to the master uplink signal using the corresponding phase component of the downlink beacon.

17. The method of claim 16, further comprising the step of:

(a) directing the master uplink signal and the slave uplink signals toward the aircraft in response to receiving the downlink beacon.

18. The method of claim 16, further comprising the step of:

(a) producing at least one error signal that is used to direct the slave uplink signals at the aircraft.

19. The method of claim 16, further comprising the steps of:

(a) producing a sum signal;

(b) demodulating the sum signal; and (c) filtering the corresponding phase component from the sum signal.

20. The method of claim 19 wherein the corresponding phase component has an amplitude, the method further comprising the step of:

(a) shifting the phase of the slave uplink signal by the amplitude of the phase component.

21. The method of claim 16, further comprising the step of:

(a) rectifying the slave uplink signals.

* * * * *